United States Patent [19]

Wilson

[11] 4,388,508

[45] Jun. 14, 1983

[54] SWITCH ACTUATING MECHANISM

[76] Inventor: Dallas W. Wilson, 2015 NW. 23rd Ave., Portland, Oreg. 97210

[21] Appl. No.: 305,544

[22] Filed: Sep. 25, 1981

[51] Int. Cl.[3] ..... H01H 3/04

[52] U.S. Cl. ..... 200/153 C; 200/153 T; 200/332; 200/86.5; 74/512

[58] Field of Search ..... 200/330, 331, 332, 153 C, 200/335, 153 H, 153 T, 86.5; 74/512, 519, 523

[56] References Cited

U.S. PATENT DOCUMENTS

| | | | |
|---|---|---|---|
| 2,482,540 | 9/1949 | Furnas et al. | 200/153 C |
| 2,801,594 | 8/1957 | Lewis | 74/519 |
| 3,303,708 | 2/1967 | Rhodes | 200/153 T |
| 3,935,410 | 1/1976 | Howard | 200/332 |

FOREIGN PATENT DOCUMENTS

| | | | |
|---|---|---|---|
| 1449305 | 7/1966 | France | 200/330 |

*Primary Examiner*—John W. Shepperd
*Assistant Examiner*—Renee S. Kidorf
*Attorney, Agent, or Firm*—Eugene M. Eckelman

[57] ABSTRACT

A flexible arm is supported in suspended relation on a holder and includes a support leaf and one or more switch actuating leaves in overlapping relation. The outer ends of these leaves are all secured together but the inner ends of the switch actuating leaves are supported freely on the support leaf. A fulcrum is disposed between the support leaf and a holder therefor and is arranged such that when the support leaf is flexed over such fulcrum, the switch actuating leaves form a lever for actuating a movable switch contact. The connection between the support lead and the support comprises a loop formed in the inner end of the support leaf which encircles and has a telescoping removable fit on a portion of the support. The flexible arm can also move away from the fulcrum to engage and move the switch contact.

13 Claims, 4 Drawing Figures

FIG. 1
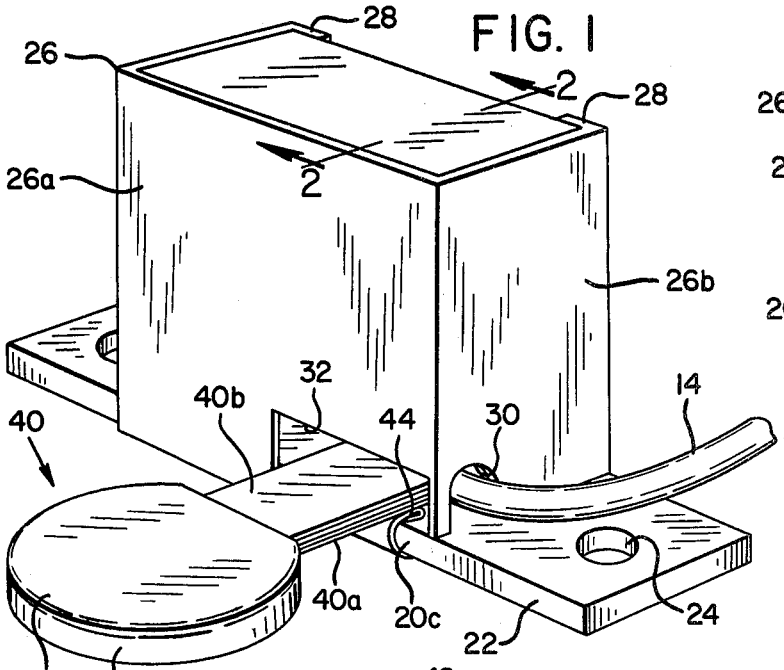
FIG. 2
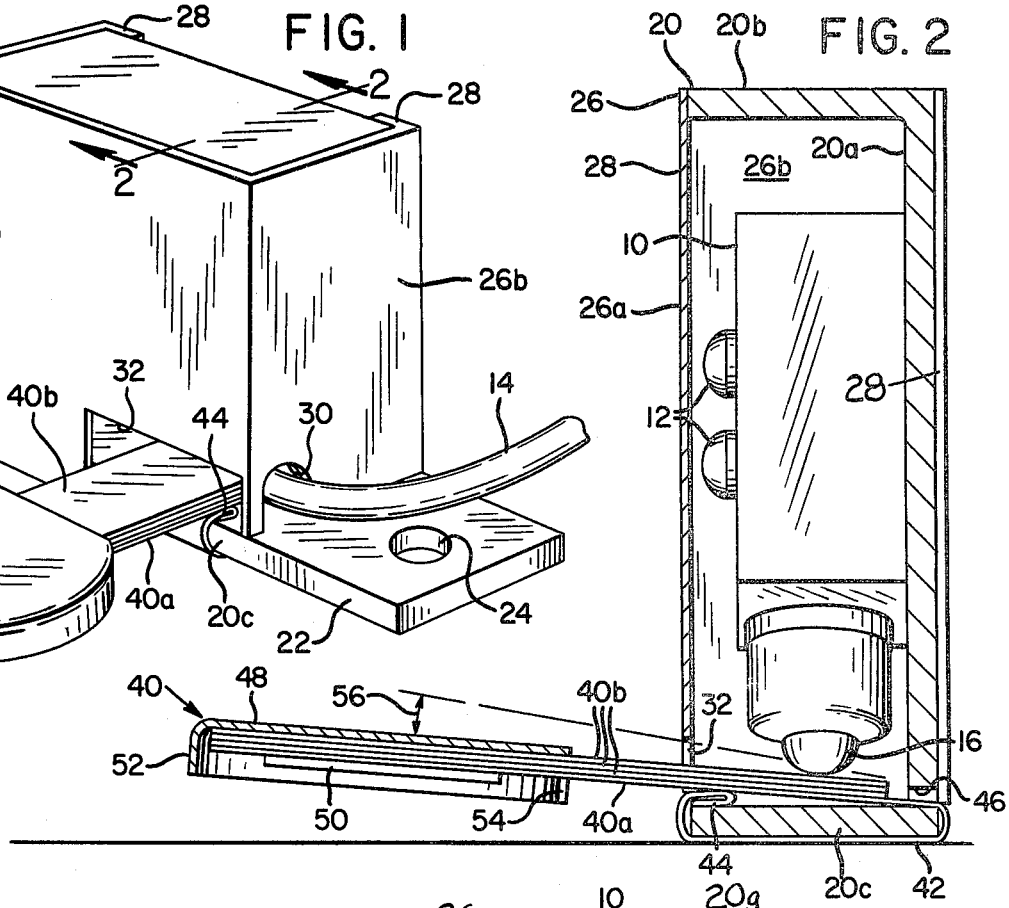
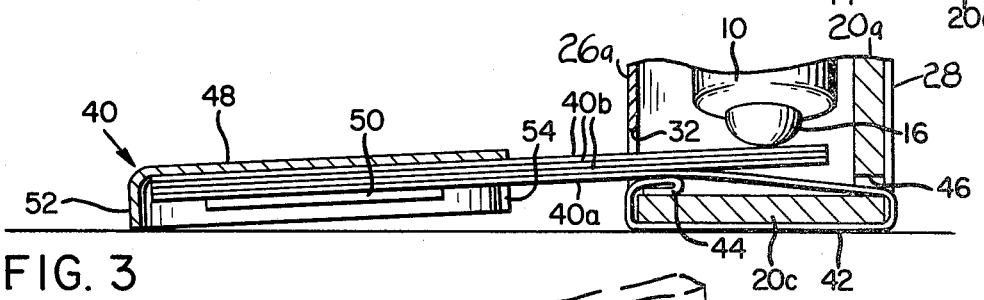
FIG. 3
FIG. 4
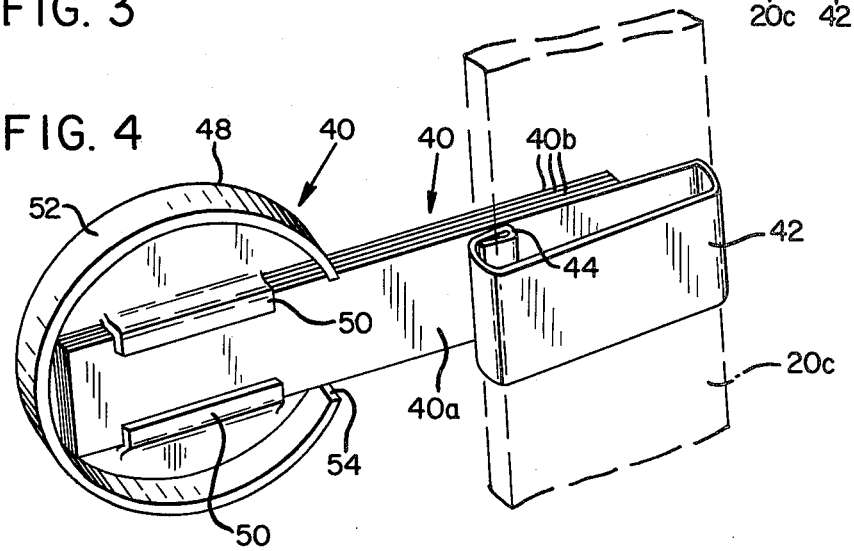

SWITCH ACTUATING MECHANISM

STATEMENT OF THE INVENTION

This invention relates to new and useful improvements in switch actuating mechanisms.

SUMMARY OF THE INVENTION

An important objective of the invention is to provide a switch actuating mechanism that is rugged in use and long lasting in operation.

Another object is to provide a switch actuating mechanism that is independently mounted relative to a switch whereby to make such actuating mechanism readily replaceable without requiring replacement of the switch, or vice versa.

Another object is to provide a switch actuating mechanism that can be structured selectively according to the pressure required to operate the switch and also structured selectively according to the travel required for operating the switch.

Still another object is to provide a switch actuating mechanism having a flexibility that prevents excessive pressure from being exerted on movable switch parts, thus eliminating the possibility of damage to the switch. The switch actuating mechanism of the invention also is arranged for a combination with a switch holder and other structure arranged to limit travel of the switch actuating mechanism, and further is arranged to activate a switch in two directions of travel such as up and down movement, for example.

For the purpose of carrying out the objectives of the invention, the switch actuating mechanism includes a flexible support arm having an outer manually engageable end and an inner end arranged for mounting on a switch holder. A switch actuating arm is supported on the support arm in overlapping engagement. Such actuating arm has an outer end secured to the outer end of the support arm and an inner end which lies freely on the inner end of the support arm. A fulcrum is disposed between the support arm and the switch holder, and the arrangement is such that upon flexing the support arm over the fulcrum by movement of its outer manually engageable end the inner end of the switch actuating arm moves away from the support arm and acts as a lever for actuating a movable switch contact. In a preferred structure, the support arm and the actuating arm comprise leaf springs, the leaves being secured together at the outer end by a pedal but being free from each other at the inner end for providing the leverage that operates the movable contact of the switch upon flexing the support arm over the fulcrum. Also, in a preferred structure, the inner end of the support arm in its support mounting on the switch holder is wrapped around a portion of the switch holder and has telescoping engagement therewith. The switch holder is arranged to be secured on a supporting surface such as a vehicle floor and has a structure such that the support arm is arranged to operate a switch contact just prior to engagement thereof with the supporting surface to prevent over-running damage to the switch. An enclosure is provided for the switch holder, and in addition to forming a housing, such enclosure is structured to lock the support arm on the switch holder.

The invention will be better understood and additional objects and advantages will become apparent from the following description taken in connection with the accompanying drawings.

BRIEF DESCRIPTION OF THE DRAWINGS

FIG. 1 is a perspective view of a switch structure embodying the present invention;

FIG. 2 is an enlarged vertical sectional view taken on the line 2—2 of FIG. 1, this view showing a normal or rest position of switch actuating mechanism of the invention;

FIG. 3 is a fragmentary sectional view taken similar to FIG. 2 but showing an operating position of the switch actuating mechanism; and FIG. 4 is a bottom perspective view of switch actuating mechanism of the invention apart from other structure.

DETAILED DESCRIPTION OF A PREFERRED EMBODIMENT

The invention is arranged for association with a conventional type switch such as a microswitch 10, FIGS. 2 and 3, and serves to provide necessary actuation of movable switch contacts under the control of an operator. Microswitch 10 has usual wire connections 12 for a lead wire 14, FIG. 2 and also has the usual movable portion 16 for actuating contacts thereof. Movable portions 16 of microswitches require very little travel, and in fact excessive travel thereof will cause damage to the switch. The invention is concerned with mechanism for actuating movable portions of switches such as switch 10 and furthermore is concerned with improvements in such mechanisms which positively operate the switch and yet cannot damage the switch.

For the purpose of illustrating the present invention, switch 10 is secured on a holder or bracket 20 having an upright rear wall **20*a* and top and bottom walls 20*b* and 20*c*, respectively, extending at right angles to the rear wall. The holder 20 is open at the front and at the ends and has end extensions 22 on its bottom wall with apertures 24** which provide means for securing the holder to a base surface such as a vehicle floor, etc.

A cover 26 is provided for the holder 20, such cover having a front wall **26*a* and end walls 26*b*. The cover closes the front and ends of the channel-shaped holder 20. The top and bottom of the cover are open. The rear is also open except that it has inturned flanges 28 extending inwardly from the side walls 26*b*. Cover 26 is inserted on the holder 20 by sliding it down over the top of the holder in a telescoping friction fit. Such cover has a bottom edge cutout 30 at one end through which the wire 14 extends and also has a cutout 32 for a purpose to be described. As best seen in FIG. 1, with the cover installed on the holder, the bottom edges of end walls 26*b* seat on the extensions 22 and preferably the front wall 26*a* is extended down farther than the end walls so as to overlap the front edge of the bottom wall 20*c*** of the holder. The cover may be held in secured position on the holder by suitable means such as by a friction fit.

The switch actuating mechanism or pedal of the invention is designated generally by the numeral 40, and has support on the holder 20, in a manner to be described hereinafter, whereby to be suspended outwardly for manual operation. The switch actuating mechanism 40 comprises a layered structure having a support arm or leaf **40*a* and one or more actuating arms or leaves 40*b*. The inner end of the support arm 40*a* provides support for the mechanism 40 on the switch holder 20 in its suspended relation. For this purpose, arm 40***a* has a loop 42 which extends over the top of the bottom wall 20*c*, around the rearward edge and along the bottom of such wall, up the front, and partially along the top under its own top portion. The inner free end of the leaf is doubled over to form a fulcrum 44. The wrapped configuration of the loop 42 is such that a rather snug fit is provided but at the same time such loop with the cover removed can be slid off over the adjacent extension 22 of the bottom wall 20*c*. For the purpose of positioning the arm 40 as best shown in FIG. 1, the rear wall 20*a* of the holder has a slot 46, FIGS. 2 and 3, along the bottom wall 20*c* of a lateral length sufficient to accommodate the width of such arm. With the cover 26 in place, the switch actuating mechanism 40 is locked on the holder 20 but is readily removable such as for repair or replacement by removing the cover and then sliding such mechanism off the adjacent extension 22.

The support arm 40*a* and the actuating arm 40*b* of the switch actuating mechanism are secured together integrally at their outer ends by a pedal cover 48 having a pair of opposed right angle tongues 50 on its bottom surface arranged to crimp this assembly of arms firmly against the bottom surface of the pedal. Pedal cover 48 has a peripheral depending flange 52 with a slot 54 through which the arm 40 extends.

According to the invention, support arm 40*a* is of sufficient rigidity to support the entire actuating mechanism 40 in suspended relation from the switch holder 20 in a normal or rest position, FIG. 2. Also, the actuating arm 40*b* is of sufficient rigidity such that when the arm 40*a* is flexed over the fulcrum 44, FIG. 3, it will move the switch member 16 sufficiently to actuate the switch. All of the layers of arms 40*a* and 40*b* may, for example, comprise leaf springs of the proper flexibility.

By using the present structure and selected flexibility of arms 40*a* and 40*b*, switches can be operated without excessive pressured operation or excessive travel thereof. That is, with selected flexibility of the arms 40*a* and/or 40*b*, the maximum leverage capable of being imparted by the arms is less than any pressure that is capable of damaging the switch. In this same regard, the multiple actuating arms 40*b* can be varied in number, thicknesses, or strengths to provide a desired switching movement or a protective pressure. Further yet, with the switch holder 20 seated on a floor surface or the like, the particular suspended support of the switch actuating mechanism can cause it to strike the floor prior to causing any excessive pressure or over-travel of the switching structure.

The fulcrum 44 can be varied in height by selected configuration of this free end of loop 42 and thus can serve additionally to provide the desired clearance or pedal elevation.

The wrap-around support of support arm 40*a* on holder 20, by means of loop 42, has many advantages. One such advantage is the easy installation and removal of the switch actuating mechanism 40 resulting from its telescoping engagement with bottom wall 20*c*. Also, an elongated flex range exists along the loop 42 and since there are no anchor points such as clamps, screws, etc., metal fatique is minimal. The structure thus has a long life. Other advantages of the wrap-around structure are that it is simplified in structure and can be replaced without replacing the switch, or vice versa.

The switch actuating mechanism 40 can also be moved upwardly as shown by arrow 56 in FIG. 2 to actuate the switch. In such upward movement, the arm 40*a* will leave the fulcrum 44 and cause arms 40*b* to actuate the switch by direct movement rather than by leverage.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A switch actuating mechanism for switches having a movable contact, comprising:

(a) a switch holder, (b) a flexible arm having an inner end mounted on said switch holder and an outer manually engageable end projecting from said switch holder, (c) a switch actuating arm supported on said flexible arm in overlapping relation and having an outer end secured to the outer end of said flexible arm and an inner end supported freely on the inner end of said flexible arm and arranged to be disposed adjacent to a movable switch contact, (d) and a fulcrum disposed between said flexible arm and said switch holder over which said flexible arm can flex, (e) said fulcrum being spaced from the inner end of said switch actuating arm to form a lever for said inner end of said switch actuating arm, (f) said flexible arm being of sufficient spring strength such that upon flexing it over said fulcrum by movement of its outer operating end the inner lever end of said switch actuating arm is pivoted for actuating a movable switch contact.

2. The switch actuating mechanism of claim 1 wherein said flexible arm comprises a leaf spring.

3. The switch actuating mechanism of claim 1 wherein said arms comprise leaf springs.

4. The switch actuating mechanism of claim 1 wherein the flexibility of said flexible arm is arranged such that the maximum pivoting force that it is capable of imparting to the lever end of said switch actuating arm is less than the force that can damage a switch from its movable contact.

5. The switch actuating mechanism of claim 1 wherein said arms comprise a plurality of leaf springs, said arms being of selected number, thickness and flexibility for efficient operation of a movable contact of a switch.

6. The switch actuating mechanism of claim 1 wherein said flexible arm is wrapped freely around at least a portion of said switch holder for providing its mounted support on said switch holder.

7. The switch actuating mechanism of claim 6 wherein said flexible arm in its portion that is wrapped around said switch holder has said fulcrum formed thereon.

8. The switch actuating mechanism of claim 6 wherein said switch holder includes a bar-like member having a free end, said wrapped portion of said flexible arm being shaped similar to the cross sectional shape of said bar-like member and being mounted on said member by endwise telescoping movement over said free end.

9. The switch actuating mechanism of claim 6 wherein said support arm also is movable in a direction opposite from its flexing movement whereby it is arranged to engage and move a switch contact, an enclosure for said switch holder, said switch holder comprising a bar-like member having a free end, said wrapped portion of said flexible arm being shaped similar to the cross sectional shape of said member and being movable on said member by endwise telescoping movement over said free end.

10. The switch actuating mechanism of claim 1 including means on said switch holder arranged to secure said switch holder on a base surface, said support of said flexible arm on said switch holder being arranged to operate a switch contact just prior to engagement of said flexible arm with a base surface on which said switch holder is secured to prevent overrunning damage to a switch.

11. The switch actuating mechanism of claim 1 wherein said flexible arm is also movable in a direction opposite from its fulcrumed movement whereby it is arranged to engage and move the same switch contact.

12. A switch mechanism comprising (a) a switch holder, (b) a movable contact, (c) a flexible arm having an inner end mounted on said switch holder and an outer operating end projecting from said switch holder, (d) a switch actuating arm supported on said flexible arm in overlapping relation and having an outer end secured to the outer end of said flexible arm and an inner end supported freely on the inner end of said flexible arm and disposed adjacent to said movable contact, (e) and a fulcrum disposed between said flexible arm and said switch holder over which said flexible arm can flex, (f) said fulcrum being spaced from the inner end of said switch actuating arm to form a lever for said inner end, (g) said flexible arm being of sufficient spring strength such that upon flexing it over said fulcrum by movement of its outer operating end the inner lever end of said switch actuating arm is pivoted for actuating said movable contact.

13. The switch mechanism of claim 12 including an enclosure on said switch holder for enclosing said switch and a portion of said flexible arm and said actuating arm, said flexible arm also being movable in a direction opposite from its fulcrumed movement to cause engagement of said switch contact by said switch actuating arm.

* * * * *